US007152889B2

(12) United States Patent
Jeffries

(10) Patent No.: US 7,152,889 B2
(45) Date of Patent: Dec. 26, 2006

(54) CABLE LATCHING SYSTEM

(75) Inventor: Mark Jeffries, Cumming, GA (US)

(73) Assignee: Austin Hardware & Supply, Inc., Lee's Summit, MO (US)

( * ) Notice: Subject to any disclaimer, the term of this patent is extended or adjusted under 35 U.S.C. 154(b) by 0 days.

(21) Appl. No.: 10/419,504

(22) Filed: Apr. 21, 2003

(65) Prior Publication Data

US 2004/0207211 A1 Oct. 21, 2004

(51) Int. Cl.
*E05C 3/06* (2006.01)

(52) U.S. Cl. ..... 292/215; 292/11; 292/27; 292/49; 292/50; 292/98; 292/224; 292/DIG. 36; 160/201; 160/280; 160/281

(58) Field of Classification Search ..... 292/215, 292/11, 27, 37, 49, 98, 140, 28, 34, 38, 159, 292/214, 222, 224, DIG. 36, 45–47, 50, 125, 292/225, 235, 133, 48; 70/90, 100, 256; 160/201, 280, 281
See application file for complete search history.

(56) References Cited

U.S. PATENT DOCUMENTS

| | | | | | |
|---|---|---|---|---|---|
| 526,278 | A | * | 9/1894 | Wesson | 292/138 |
| 1,019,678 | A | * | 3/1912 | Mason | 292/37 |
| 1,724,995 | A | * | 8/1929 | Dautrick | 160/191 |
| 1,804,329 | A | * | 5/1931 | Farr | 160/190 |
| 1,820,238 | A | * | 8/1931 | Mears et al. | 292/215 |
| 1,858,804 | A | * | 5/1932 | Carlson | 292/36 |
| 1,865,581 | A | * | 7/1932 | Miller | 292/223 |
| 1,865,778 | A | * | 7/1932 | Mears et al. | 292/217 |
| 1,949,805 | A | * | 3/1934 | McGary et al. | 16/96 R |
| 1,955,434 | A | * | 4/1934 | Moore | 292/215 |
| 1,967,587 | A | * | 7/1934 | Moore | 292/49 |
| 2,032,754 | A | * | 3/1936 | Johnson | 16/49 |
| 2,039,296 | A | * | 5/1936 | Collins | 160/191 |
| 2,040,080 | A | * | 5/1936 | Collins | 160/191 |
| 2,124,970 | A | * | 7/1938 | Bagley | 292/40 |
| 2,189,019 | A | * | 2/1940 | Rowe | 160/209 |
| 2,195,542 | A | * | 4/1940 | Shaffer et al. | 292/66 |
| 2,285,301 | A | * | 6/1942 | Nelson | 292/126 |
| 2,375,837 | A | * | 5/1945 | Buehner | 160/209 |
| 2,427,909 | A | * | 9/1947 | Howell | 70/216 |
| 2,580,584 | A | * | 1/1952 | Nowak | 292/36 |
| 2,581,885 | A | * | 1/1952 | Robinson | 403/107 |
| 2,612,396 | A | * | 9/1952 | Venditty | 292/47 |
| 3,027,188 | A | * | 3/1962 | Eichstadt | 296/51 |
| 3,163,033 | A | * | 12/1964 | Boyles | 70/100 |
| 3,177,022 | A | * | 4/1965 | McKee et al. | 292/50 |
| 3,333,878 | A | * | 8/1967 | Pelcin | 292/37 |
| 3,683,652 | A | * | 8/1972 | Halopoff et al. | 70/467 |
| 3,776,007 | A | * | 12/1973 | Himsl | 70/86 |
| 3,953,061 | A | * | 4/1976 | Hansen et al. | 292/5 |
| 4,036,039 | A | * | 7/1977 | Nakanishi | 70/90 |
| 4,068,871 | A | * | 1/1978 | Mercer | 292/48 |
| 4,273,368 | A | * | 6/1981 | Tanaka | 292/53 |
| 4,461,160 | A | * | 7/1984 | Van Gompel | 70/100 |

(Continued)

*Primary Examiner*—Brian E. Glessner
*Assistant Examiner*—Carlos Lugo
(74) *Attorney, Agent, or Firm*—Polsinelli Shalton Welte Suelthaus PC

(57) ABSTRACT

A latching system includes a rotatable cam formed of substantially symmetric pieces with a cable, connected to oppositely disposed bolts, extending therethrough. The configuration of the cam is such that when rotated, the cable is pulled in both directions with respect to each of the bolts, allowing for the bolts to move so as to disengage from their respective strikers, unlatching the system.

19 Claims, 6 Drawing Sheets

U.S. PATENT DOCUMENTS 4,893,849 A * 1/1990 Schlack ..... 292/7
5,022,691 A * 6/1991 Clay, Jr. ..... 292/121
5,078,194 A * 1/1992 Phillips ..... 160/84.04
5,078,197 A * 1/1992 Weishar ..... 160/265
5,246,054 A * 9/1993 Shepherd et al. ..... 160/133
6,006,560 A * 12/1999 DeVries ..... 70/208
6,086,121 A * 7/2000 Buckland ..... 292/34
6,141,913 A * 11/2000 Wong et al. ..... 49/465
6,588,150 B1 * 7/2003 Wong et al. ..... 49/183
6,601,884 B1 * 8/2003 Bastian ..... 292/222

* cited by examiner

CABLE LATCHING SYSTEM

TECHNICAL FIELD

The present invention relates to latching systems and in particular to latching systems for roll up doors and other draw-down closing devices.

BACKGROUND

Roll-up doors are commonly found in industrial and commercial establishments, between various parts of a plant, warehouse or the like. These roll-up doors typically include multiple hinged panels, with rigid ends that rest in tracks. These tracks are at opposite ends of the door and are typically attached to the walls surrounding or proximate to the door. The upper portion is attached to a take up member, that is counterbalanced or rotated, by a motor or the like, when opening the door is desired, functions as a spool to take up the door panels as the door moves upward. The system works in reverse when the door panel moves downward, when closing of the door is desired.

These doors typically include a latching system along the panels, for preventing movement of the door when it is in a down or closed position. This latching system is typically a central cam attached to a handle, that connects to rigid rods of equal length or independent latches at each end. When the cam rotates, it pulls the rods inward at equal distances, so as to free the rods from their locked positions, allowing the engagement to be released, and the door moved upward or opened.

These latching systems exhibit drawbacks in that they must be left open (rods inward) to close the unit, and then extend the rods. They require close tolerances to match rod ends and holes and close tolerances over the length of the door. Also, these systems require higher door panel heights, as the rods have to move linearly and over longer distances. The rods can flex or bow over a long door when they do not align with and enter their designated receiving hole. They also are of thick profiles, and thus can not fit into the spaces desired, for both functional and aesthetic purposes.

SUMMARY

The present invention is directed to a latching system, for example, for use with roll up doors. The latching system employs a single cable to draw in the end bolts, that are typically in an outward or rest position, as biased by a spring or the like. The bolts and thus, the door, is blocked from upward movement by outwardly protruding strikers. This system employs few parts when compared to conventional systems, and it is tolerant of manufacturing variations. It is of a cost-effective design and of a thin profile, so as to be of increased functionality and asthetics, when compared to conventional systems. The system employs a cam of substantially symmetric members, that upon rotation, changes (displaces) the path of the cable in both directions, such that spring loaded bolts, connected to the cable, can be pulled clear of strikers blocking them, allowing for example, the door, to be moved upward to an open position. As a result of this structure, the cam, and thus, the handle that rotates it, need not be centrally positioned.

Additionally, the cam orientation may be adjusted around the axis of the cable, as the cam need only displace the cable, causing it to change length or change its path, in order to move the bolts. Accordingly, the cam can be placed anywhere along the cable and at any orientation with respect to the bolts, provided it will displace the cable to cause movement of the bolts.

In the latching systems disclosed herein, a cam is only one form of a displacement member that can be used in displacing the cable, causing it to change length, or change its path. Also, the latching system is suitable for multiple roll up door assemblies, and does not have to be modified. The bolts can have a variable throw.

An embodiment of the invention is directed to a latching system. This latching system includes a first member and a second member configured for movement between inward and outward positions. There is a cable in communication with the first member and the second member, and there is a member for displacing the cable to move the first and second members. The first and second members are typically bolts, that are spring biased to be in the outward position, while the member for displacing the cable is, for example, a cam, that is rotatable.

Another embodiment is directed to a roll up door system. This roll up door system includes a door having at least one panel; a first member and a second member movably mounted on the at least one panel for movement between inward and outward positions; and a cable in communication with the first member and the second member. There is also a member for displacing the cable to move the first and second members. The first and second members are typically bolts, that are spring biased to be in the outward position, while the member for displacing the cable is, for example, a cam, that is rotatable.

Another embodiment is directed to a latching system having first and second members for being movably mounted on at least one support for moving between inward and outward positions. There is also a cable in communication with the first and second members; and a member for displacing the cable to move the first and second members inward. The first and second members are configured such that one of the members will continue to move inward when the other of the members has been stopped from moving inward. The first and second members are typically bolts, that are spring biased to be in the outward position, while the member for displacing the cable is, for example, a cam, that is rotatable.

BRIEF DESCRIPTION OF THE DRAWINGS

Attention is now directed to the drawings, where like numerals and characters indicate like or corresponding components. In the drawings.

DETAILED DESCRIPTION OF THE DRAWINGS

Figure 1:
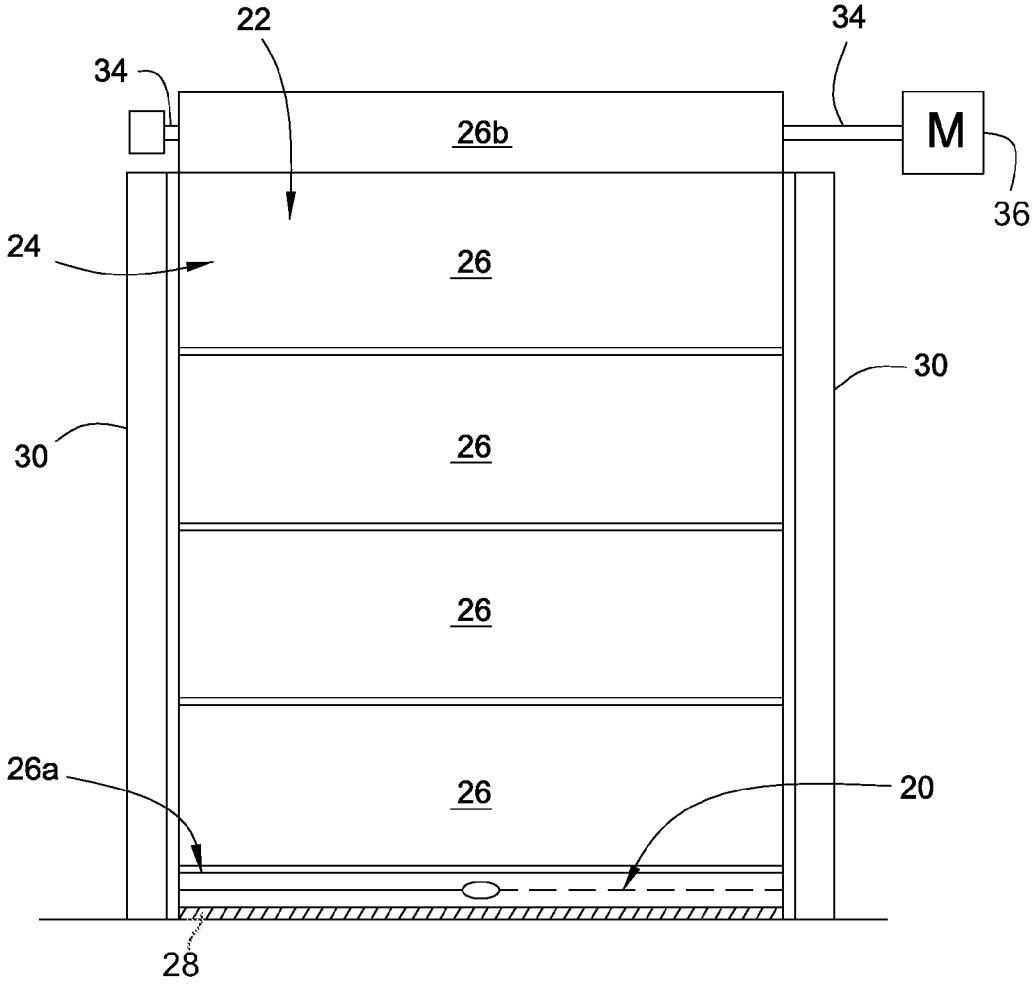
FIG. 1 is a rear view of a roll up door employing the latching system of the present invention.

FIG. 1 shows the latching system 20 of the present invnetion in an exemplary use with a roll-up door assembly 22. The roll-up door assembly 22 includes a door 24, formed of panels 26, with the latching system 20 on a lower panel 26*a*, typically the panel adjacent to the sealing member 28. The door assembly 22 includes tracks 30, disposed at opposite ends of the door 24.

The door panels 26, typically include reinforcing members 31, that along with the panel ends 26*e*, extend into the tracks 30. The uppermost panel 26*b* is attached to a rotateable rod 34, typically rotated by a motor 36 or counterbalanced with a torsion spring. This rod 34 functions as a take up spool for the door 24 when it is rotated, when the door 24 is opened. When the door 24 is to be closed, by being rolled downward, the aforementioned process is reversed.

Throughout this document, references are made to directions including, upper, lower, upward, downward, outward, inward, front and rear. These directions are for explanation purposes only, to illustrate the system 20 in an exemplary orientation.

Figure 2:
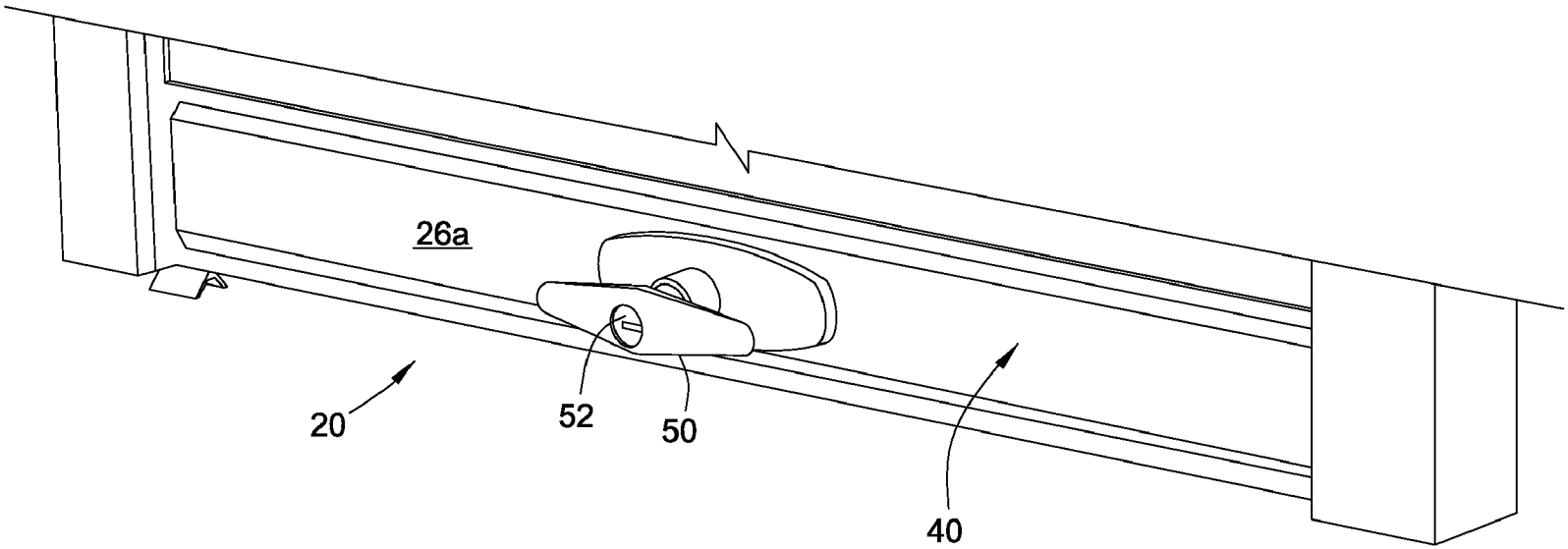
FIG. 2 is a front perspective view of the handle of latching system of the present invention.
Figure 3A:
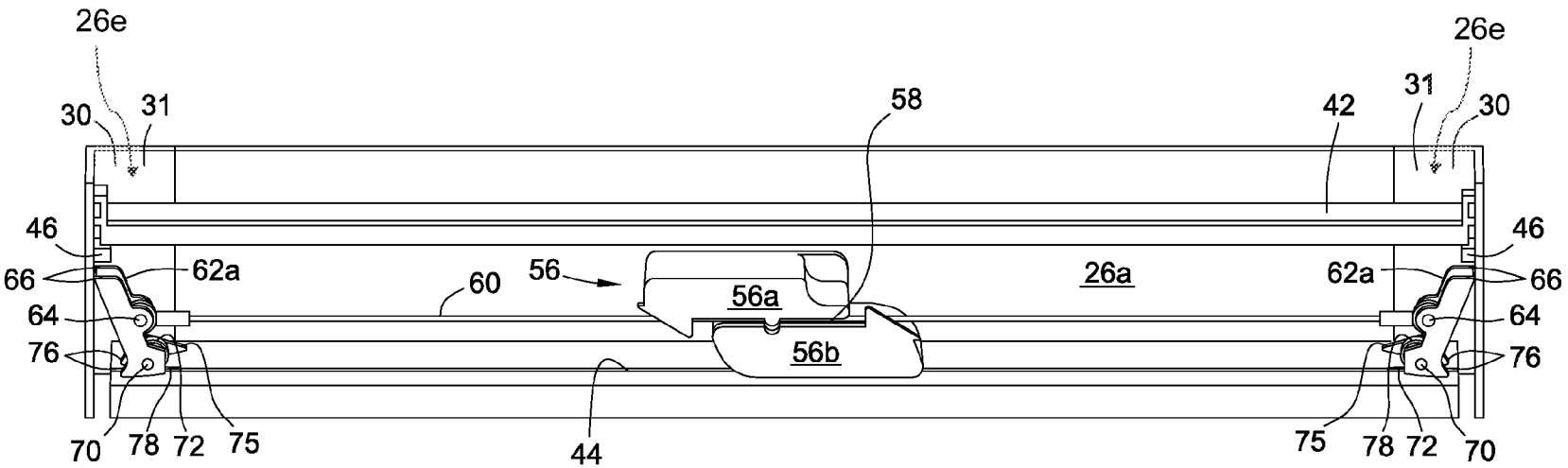
FIG. 3A is a rear view of the latching system of the present invention, with the bolts in the engaged position.
Figure 3B:
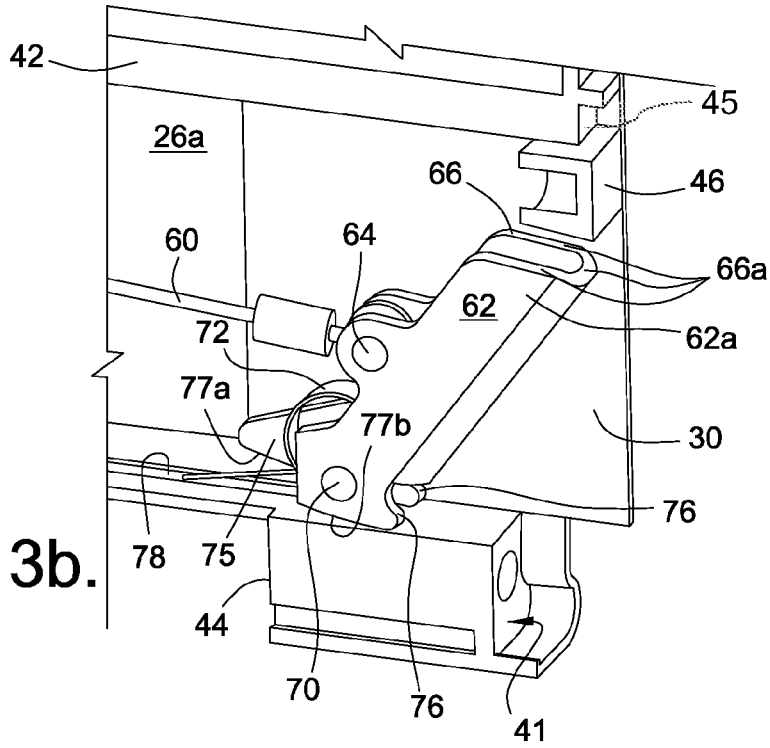
FIG. 3B is a perspective view of a bolt of FIG. 3A.

Turning also to FIGS. 2 and 3A and 3B, the panel 26*a* typically includes a body 40 joined to end blocks 41, that together have integral upper 42 and lower 44 supports. The upper 42 and lower 44 supports typically extend partially into the tracks 30, with end members 45 attached to the upper support 42, for abutting the respective striker 46, that extends outward from the respective track 30, and functions as a stop surface for the end members 45, limiting movement of the door 24.

A handle 50 extends into the body 40. This handle 50 is movable, typically by being rotated clockwise or counterclockwise. The handle 50 may include a lock 52, such as one opened by a key, to prevent movement of the handle 50 when desired.

The handle 50 attaches to a cam 56, typically formed of similar members 56*a*, 56*b*, oppositely disposed with respect to each other, with a slot 58 between them. Movement of the handle 50, for example, in a clockwise rotation, causes the cam 56 to move a cable 60, typically displacing it. The cable 60 is connected to bolts 62, that upon cable movement (displacement), move the bolts 62 from an engaged position (FIGS. 2, 3A and 3B), where upward movement of the door 24 is restricted (as the respective strikers 46 serve as stop surfaces for the bolts 62, should the door 24 be attempted to be moved upward for opening it), to a disengaged position (FIGS. 6A and 6B), where the bolts 62 are clear of the respective strikers 46. The door 24 can now be moved upward and opened.

The handle 50 attaches to the cam 56 by conventional mechanisms, such that the handle 50 drives the cam 56. The handle 50 and cam 56 assembly can also include springs (not shown) that move the handle 50 and cam 56 back to their original or starting positions when the handle 50 is released.

The cable 60, extends from bolts 62 through the slot 58. The cable 60 is typically attached at a joint 64 on the respective bolt 62, typically centrally or substantially centrally located on the respective bolt 62. The joints 64 on the bolts 62 are typically at the same elevation as the slot 58, such that the cable is straight in its rest position and substantially parallel to the upper 42 and lower 44 supports of the panel 26*a*. Other joint 64 positions along the bolt 62 are suitable, provided the cam 56 and slot 58 are positioned to allow for sufficient increases in path length of the cable 60, when the cam 56 is rotated, to pull the bolts 62. This cable 60 is of a length sufficient such that the upper portion 62*a* of the respective bolts 62, and in particular, the edges 66 (having upper edge surfaces 66*a*) of the respective bolts 62, extend under the respective strikers 46.

The bolts 62 are mounted on the lower support 44 of the end blocks 41, typically by pivotal mounts at pivotal joints 70. A torsion spring 72, or other biasing member, is typically placed at the pivotal joints 70. This torsion spring 72, for example, a coil with outwardly extending prongs, pushes the bolts 62 outward (here, for example, with the bolts 62 pivoting in a clockwise direction), such that at least portions of the edges 66 and their upper edge surfaces 66*a*, of the respective bolts 62, extend under the respective strikers 46, restricting movement of the door 24.

As shown in FIG. 3B, the bolts 62 are formed of a body 74 and an outwardly protruding toe portion 75 and a heel 76 or stop portion with edge surfaces 77*a*, 77*b*. This toe portion 75 serves to limit travel inward (inward pivoting) of the bolts 62, while the heel portion 76 limits outward travel (outward pivoting) of the bolts 62. The biasing force of the torsion spring 72 id typically of a strength sufficient to allow the respective bolts 62 to rotate until the heel portion 76 contacts the surface 78 of the end block 41.

When the bolt 62 is in the engaged or outward position, the edge surface 77*a* of the toe portion 75 is angled with respect to the surface 78 of the end block 41, as it is forced outward by the spring 72. This toe portion 75 protrudes from the body, such that when the bolt 62 is pulled inward to a retracted position, once it has traveled such that its edge surface 77*a* abuts the surface 78 of the end block 41, further inward movement of the bolt 62 (FIG. 6B) is prevented. The toe portion 75, by its abutment with the surface 78 of the end block 41, functions for force compensation (for example, as a differential), stopping movement of the requisite bolt 62, but allowing for forces from the cam 56 to act on the other bolt 62 until it has been moved (pulled) clear of its respective striker 46.

Figure 4:
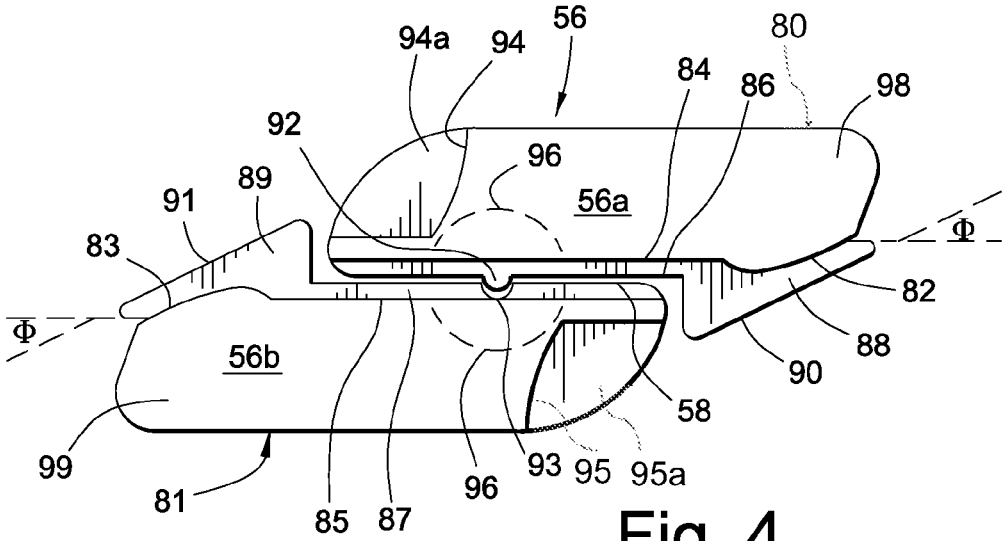
FIG. 4 is a front view of the cam of the latching system with the cable removed.

As shown in FIG. 4, the cam 56 is formed of similar members 56*a*, 56*b*, typically substantially symmetric with respect to each other. Both cam members are formed of main bodies 80, 81. These main bodies 80, 81 include outwardly curved ledges 82, 83 and flat portions 84, 85, that define the slot 58 for the cable 60. The ledges 82, 83 are typically of a radius of curvature large enough to prevent kinking of the cable 60.

The rear sides 82, 83 the respective main bodies 80, 81 include walls 86, 87 (shaded to emphasize their rearward location), that extend beyond the bodies 80, 81. These walls 86, 87 serve to retain the cable 60 in the slot 58 between the bodies 80, 81. The walls 86, 87 include a flange portion 88, 89, extending beyond the ledges 82, 83. These flange portions 88, 89 typically include a flat edge 90, 91 at an angle Φ, for example, approximately 35 degrees. This angling coupled with the flat edge 90, 91, serves as a limit of travel for the cam 56 as well as the rotation of the handle 50.

The first member 56*a* includes a cut out 92, typically rounded, with a correspondingly shaped protrusion 93 proximate thereto, on the second member 56*b*. There are also cut away sections 94, 95, exposing rear walls 94*a*, 95*a*, for clearance of the bolts/nuts and other attachment structures (not shown) for the handle 50. The handle 50 attaches to the respective cam members 56*a*, 56*b* at attachment points 96 along the front walls 98, 99 of the respective bodies 80, 81, by any one of numerous conventional attachments.

Alternately, if the cam 56 were configured oppositely, movement of the handle 50 in a counterclockwise rotation would result in the bolts 62 being pulled from the engaged to the disengaged positions, as detailed above.

Figure 5A:
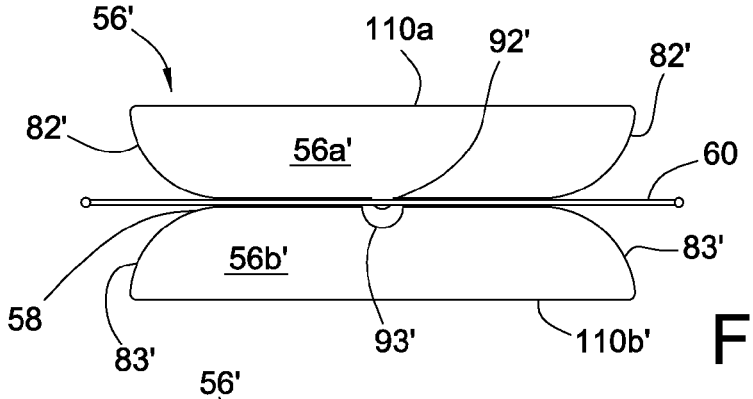
FIGS. 5A–5C are diagrams of an alternate embodiment of a cam for the latching system of the present invention.
Figure 5B:
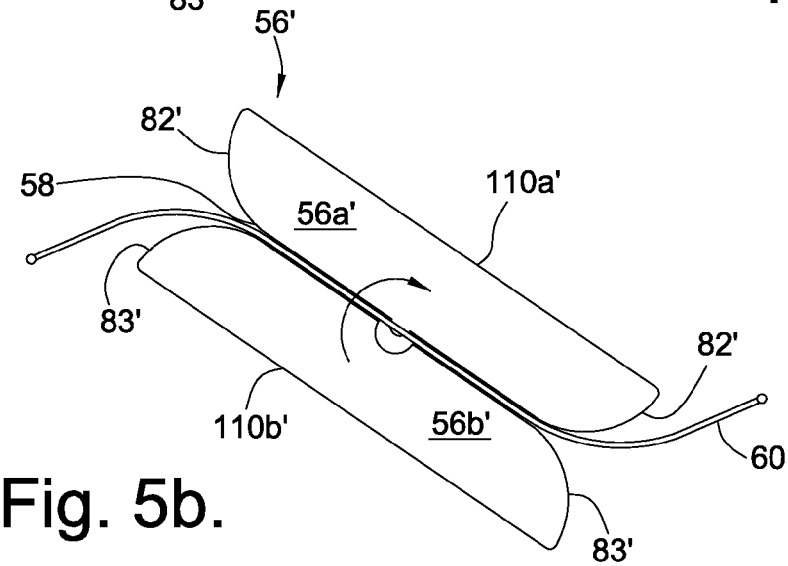
Figure 5C:
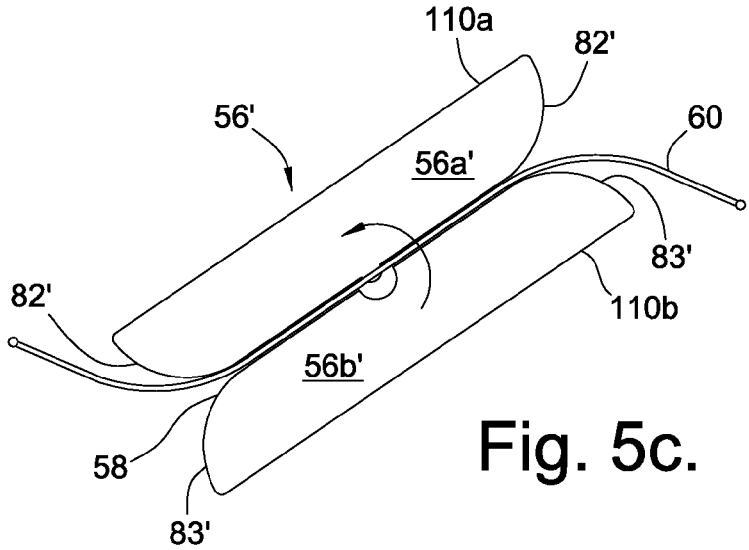

In another alternate embodiment, as shown in FIGS. 5A–5C, the cam 56' can also be configured symmetrically, to work in both directions, for example clockwise (FIG. 5B) and counterclockwise (FIG. 5C), when rotated by the handle 50 (FIG. 2). In this embodiment members 56*a*' and 56*b*' are constructed in accordance with the cam members 56*a*, 56*b*, detailed above. Other components, similar to those detailed herein, but particular to this can 56' have the same numbers plus a prime ('). The cam members 56*a*', 56*b*' rest in alignment with each other and have outer sides 110*a*, 110*b* with curved portions 82', 83' of a radius of curvature large enough to prevent kinking of the cable 60.

Figure 6A:
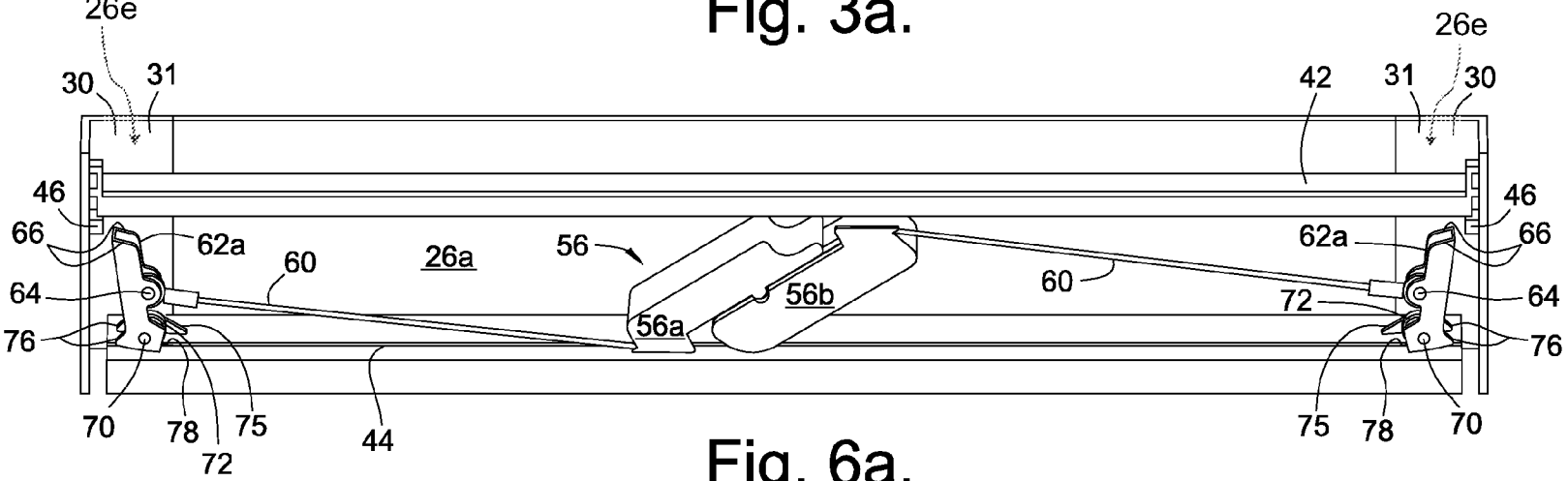
FIG. 6A is a cut-away rear view of the latching system with the cam rotated and the bolts in the disengaged position.
Figure 6B:
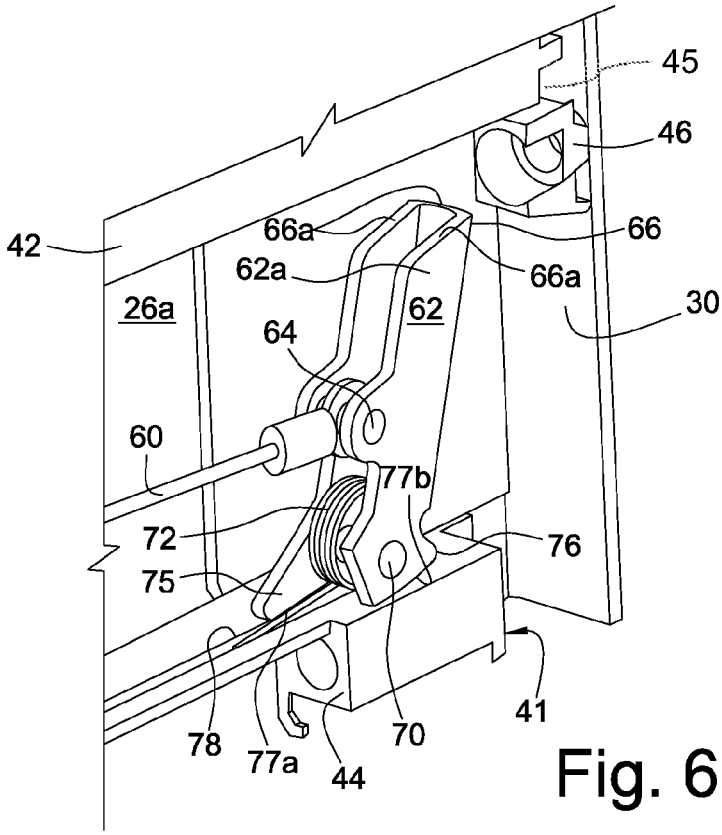
FIG. 6B is a perspective view of a bolt of FIG. 6A.

Turning also to FIGS. 6A and 6B, the latching apparatus 20 is shown in the disengaged position, as the bolts 62 have been pulled by the cable 60, that has been forced to bend around the ledges 82, 83 of the cam members 56*a*, 56*b*. (The cam members 56*a*, 56*b* having been moved by the handle 50 being rotated). This bending of the cable 60 has shortened its lateral length. Here, for example, with the cam 56 positioned centrally (here, equidistant) with respect to the bolts 62, the cable 60 is pulled and thus, its lateral length is shortened equally in both directions, such that the bolts 62 have been pulled about the respective pivotal joint 70, such that their edges 66 are clear (beyond the plane) of the respective strikers 46.

The pivoting of the bolts 62 typically continues until the edge surfaces 77*a* of the toe portions 75 of the bolts 62 abut the respective surfaces 78 of the respective end blocks 41. This abutment prevents any further inward pivoting of the bolts 62.

The cable 60 remains in the slot 58 during this process. The cam 56 has been rotated, for example, to approximately 35 degrees, where its further rotation is prevented by the either or both of the edges 90, 91 of the flange portions 88, 89 contacting the respective supports 42, 44.

Alternately, the cam 56 can be located off center with respect to the bolts 62. This is due to the symmetry of the cam members 56*a*, 56*b*, being such that rotation of the cam 56 shortens the cable 60 approximately the same in both lateral directions, to release the bolts 62 clear of their respective strikers 46. Accordingly, this is also true for the handle 50.

In other alternate embodiments, the cam 56 can be much closer to one of the bolts 62 than the other. If one bolt 62 has been rotated as far i remaining portion of the rotation would then be applied to pull the other bolt 62 (requiring the extra force) clear of the respective striker 46. Here, the toe portion 75 (its edge surface 76) would abut the surface 78 of the end block 41 for the bolt 62 that first cleared its respective striker 46 (similar to that shown in FIGS. 6A and 6B and described above), allowing this bolt 62 to remain clear of the striker 46, while the remaining force, generated as the cam 56 completes its rotation, pulls the other bolt 62 inward, clear of its respective striker 46.

In additional alternate embodiments, the cam 56 can be at any orientation with respect to the plane of the bolts 62. The cam 56 does not have to be coplanar with respect to the bolts 62, as shown and described above.

In other embodiments, the cam 56 can be replaced by a member or members that cause displacement of the cable 60. This displacement can be, for example, a rod, activated by a spring mechanism, such as a button or the like, that displaces the cable 60, changes its length or changes its path.

Figure 7:
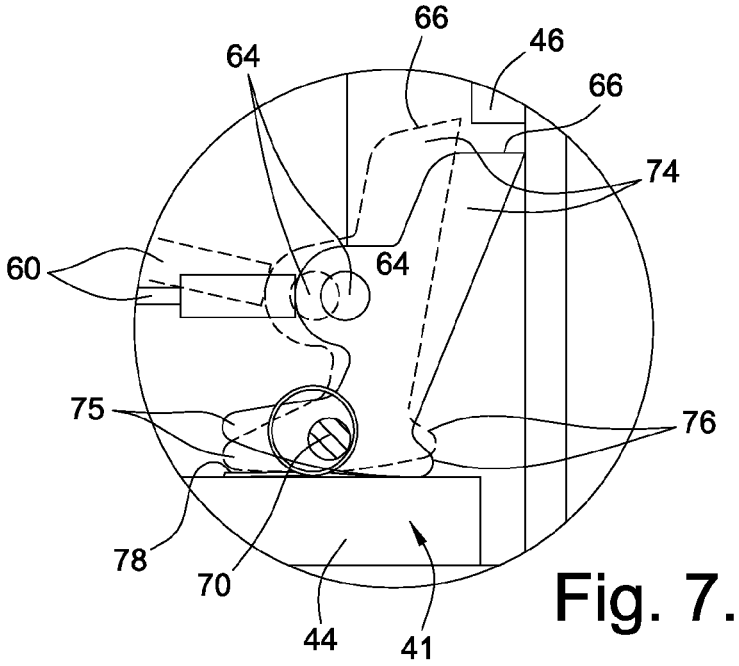
FIG. 7 is a rear view of a bolt showing the present invention in an exemplary operation.

Turning to FIG. 7, an exemplary operation of the latching apparatus 20 is shown and described. Throughout this description, reference is also made to FIGS. 1–4, 6A and 6B, and the accompanying description above.

Initially, the apparatus 20 is at rest in its engaged position, as the bolts 62 (shown in FIG. 7 in solid lines) are under the respective strikers 46, and the cable 60 is fully extended, as also shown in FIGS. 3A and 3B. When opening the door 24 is desired, the user will unlock (if necessary) the handle 50. The handle 50 will then be rotated clockwise, for example, moving the cam 56 concurrently with it, until both of the cam members 56*a*, 56*b* have been rotated in an arc of approximately 35 degrees, such that further rotation is no longer permissible.

The cam members 56*a*, 56*b* have now rotated, with the cable 60 sliding through the slot 58 and bending around the ledges 82, 83 of the cam members 56*a*, 56*b*. This results in the cable 60 shortening its lateral length, to pull the bolts 62 inward, such that they have cleared the respective strikers 46, as shown in broken lines in FIG. 7 and also in FIGS. 6A and 6B. The handle 50 is maintained in this rotated position and the door 24 is lifted upward to the opening height desired. Once the bolts 62 are above and clear of the respective strikers 46, the handle 50 may be released, typically being returned to its initial position by the spring mechanism, such that the latching apparatus 20 returns to this rest position.

When closing the door 24 is desired, the user need only to pull down on the door 24, at any panel or 26, 26' or by the handle 50. As the door 24 moves downward, the bolts 62 will contact the respective strikers 46 and their shape and positioning will allow the bolts 62 to momentarily pivot inward while contacting the respective strikers 46. This causes some momentary play in the cable 60. Once past the strikers 46, the bolts 62 will pivot outward, back to their engaged position (FIGS. 3A and 3B)(as the cable 60 will become tense, losing the slack or play). The door 24 has now been closed and the handle 50 may be locked, such that it can not be rotated and thus, the cam 56 can not be moved (rotated).

While the latching system 20 has been shown for use with roll-up doors, it is also suitable for tool box drawers and other similar drawers to latch them shut. Additionally, the latching system 20 disclosed will work with any structure that latches on two sides, for example, anywhere slam bolts are typically used.

There has been shown and described at least one preferred embodiment of a latching system. It is apparent to those skilled in the art, however, that many changes, variations, modifications, and other uses and applications for the latching system and its components are possible, and also such changes, variations, modifications, and other uses and applications which do not depart from the spirit and scope of the invention are deemed to be covered by the invention, which is limited only by the claims which follow.

What is claimed is:

1. A roll up door system comprising:

a door including at least one panel;

a first latch member and a second latch member movably mounted on said at least one panel for movement between inward and outward positions;

a cable in communication with said first latch member and said second latch member; and, a cam member for displacing said cable to move said first and second latch members, said cam member including, a first portion including a first flat portion, and a second portion including a second flat portion, said first and second portions being disposed with respect to each other so the first flat portion and the second flat portion define a substantially straight slot configured for receiving an at least substantially straight portion of said cable, wherein the first portion forms a first outwardly curved edge and the second portion forms a second outwardly curved edge, wherein the first curved edge and the second curved edge are positioned at opposite ends of the substantially straight slot.

2. The roll up door system of claim 1, additionally comprising:

at least one track configured for receiving said door at a lateral end.

3. The roll up door system of claim 2, wherein said at least one track includes two tracks, said two tracks oppositely disposed with respect to each other, each of said tracks including at least one striker therein, each of said at least one strikers configured extend over said respective first and second latch members when said first and second latch members are in said outward positions.

4. The roll up door system of claim 1, wherein said first and second latch members movably mounted on said at least one panel are pivotally mounted on said at least one panel.

5. The roll up door system of claim 4, wherein said at least one panel includes a body and oppositely disposed end blocks at the ends of said body, and said first and second latch members are pivotally mounted to said panel members at joints on each of said end blocks.

6. The roll up door system of claim 1, wherein said first latch member and said second latch member are biased to said outward position.

7. The roll up door system of claim 6, wherein said first latch member and said second latch member each include:

a bolt; and, a spring in communication with said bolt for biasing said bolt to said outward position.

8. The roll up door system of claim 7, wherein said bolt includes at least one toe portion configured for limiting travel of said bolt.

9. The roll up door system of claim 1, wherein said first and second portions are substantially symmetric with respect to each other.

10. The roll up door system of claim 9, additionally comprising a handle in communication with said cam member for rotating said cam member.

11. The roll up door system of claim 10, wherein said handle is configured to be rotatable and includes a lock for inhibiting rotation of said handle.

12. The roll up door system of claim 1, wherein the first outwardly curved edge and the second outwardly curved edge are positioned at opposite ends of the substantially straight slot, said cable curves around the first outwardly curved edge, said cable passes through the substantially straight slot, and said cable curves around the second outwardly curved edge.

13. The roll up door system of claim 1, wherein the rotation of the cam member displaces said cable to create a pulling force on the first latch member and the second latch member.

14. The roll up door system of claim 13, wherein the cam member transfers the pulling force between the first latch member and the second latch member to move the first and second latch members.

15. The roll up door system of claim 13, wherein the cam member transfers the pulling force between the first latch member and the second latch member by displacing said cable to move the first and second latch members.

16. The roll up door system of claim 1, wherein the first portion includes a first flange portion and the second portion includes a second flange portion, wherein the first flange portion and the second flange portion limit the rotation of the cam.

17. The roll up door system of claim 1, wherein the first flat portion and the second flat portion define the substantially straight slot, the substantially straight slot enclosing said cable on at least two sides of said cable.

18. The roll up door system of claim 1, wherein the first portion and the second portion are an integral unit.

19. A roll up door system comprising:

a door including at least one panel;

a first latch member and a second latch member movably mounted on the at least one panel for movement between inward and outward positions;

a cable in communication with the first latch member and the second latch member; and, a cam member for displacing the cable to move the first and second latch members, the cam member including, a first portion including a first flat portion, the cam member including a second portion including a second flat portion, the first and second portions being disposed with respect to each other so the first flat portion and the second flat portion define a slot configured for receiving the cable, wherein the cable extends through the slot, wherein the first portion forms a first curved edge and the second portion forms a second curved edge, wherein the first curved edge and the second curved edge are positioned at opposite ends of the slot, the cable curving on the first curved edge and on the second curved edge, wherein the cam member transfers the pulling force between the first latch member and the second latch member by displacing the cable to move the first and second latch members.

* * * * *

UNITED STATES PATENT AND TRADEMARK OFFICE

CERTIFICATE OF CORRECTION

PATENT NO. : 7,152,889 B2
APPLICATION NO. : 10/419504
DATED : December 26, 2006
INVENTOR(S) : Mark Jeffries It is certified that error appears in the above-identified patent and that said Letters Patent is hereby corrected as shown below:

Column 5, Line 47 "i" should be
-- inward as possible, the force generated from the --

Signed and Sealed this

First Day of May, 2007

JON W. DUDAS
*Director of the United States Patent and Trademark Office*